United States Patent [19]

Dumbser

[11] Patent Number: 4,461,501

[45] Date of Patent: Jul. 24, 1984

[54] LOCK SYSTEM FOR MOTOR VEHICLES

[75] Inventor: Gerhard Dumbser, Niederwerrn, Fed. Rep. of Germany

[73] Assignee: Fichtel & Sachs AG, Schweinfurt, Fed. Rep. of Germany

[21] Appl. No.: 261,016

[22] Filed: May 6, 1981

[30] Foreign Application Priority Data

May 7, 1980 [DE] Fed. Rep. of Germany ..... 3017402

[51] Int. Cl.[3] ..... E05B 47/00

[52] U.S. Cl. ..... 292/201; 292/336.3

[58] Field of Search ..... 292/201, 144, 336.3, 292/1

[56] References Cited

U.S. PATENT DOCUMENTS 1,700,433 1/1929 Cox ..... 292/201 X 3,243,216 3/1966 Peters ..... 292/201

4,269,440 5/1981 Gelhard ..... 292/201 X

*Primary Examiner*—Richard E. Moore

*Attorney, Agent, or Firm*—Toren, McGeady and Stanger

[57] ABSTRACT

In a locking system particularly suitable for a motor vehicle for use with unidirectional electrical motors, there is interposed between motors of the system and locking elements individually driven by said motors, a driving mechanism including a driven member coupled with each of the locking elements, an eccentric drive element engaging said driven member to move the locking elements between locking and unlocking positions, and elastic means interposed between the driven member and the eccentric drive element to permit the motors to continue to rotate the eccentric drive element when movement of any one of the locking elements is obstructed.

12 Claims, 2 Drawing Figures

LOCK SYSTEM FOR MOTOR VEHICLES

The present invention relates generally to locking systems particularly suitable for use in motor vehicles and more particularly to a driving mechanism for such locking systems operable to control locking of doors, tops and hoods of such motor vehicles.

A door locking system for motor vehicles is known from U.S. Pat. No. 3,243,216 wherein the system can be locked or unlocked in a conventional manner by means of a key or by an operating rod which ends in an actuating button at the vehicle door. This driving mechanism has a unidirectional electrical geared motor which also acts upon the operating rod by means of an eccentric drive device. The eccentric drive includes a driven member which is slidably supported on the operating rod and which is pressed by a spring against a fixed stop of the operating rod. An eccentric element of the eccentric drive mechanism moves the driven member and consequently the operating rod between a first position wherein the lock is in the locked condition and a second position in which the lock is unlocked, and vice versa.

The motor is connected by a control circuit to always effect rotation of the eccentric element through one half of a rotation. Since the driven member is supported for the operating rod to be slidable against the force of the spring, the door lock can be manually unlocked even if the eccentric drive is blocked which may, for example, occur due to failure of the system.

The geared motor of the known driving mechanism is only disconnected at the final position. However, this final position is not reached if the locking mechanism is blocked, for example by icing or due to failure. This may lead to destruction or damage of the drive motor or of the eccentric drive mechanism of this known device.

The present invention is directed toward improving driving mechanisms for locking arrangements of motor vehicles in such a manner that damage will not occur even during obstruction of the locking mechanism of the system.

SUMMARY OF THE INVENTION

Briefly, the present invention may be described as a locking system particularly suitable for a motor vehicle for use with a unidirectional electric motor comprising lock means movable between a locking and an unlocking position, a driven member coupled with said lock means, an eccentric drive element for engaging said driven member to move said lock means between said locking and unlocking position, motor means for rotatively driving said eccentric element, control circuit means including switch means responsive to the position of said lock means for controlling operation of said motor means, and elastic means interposed between said driven member and said eccentric drive element to permit said motor means to continue to rotatively drive said eccentric drive element when movement of said lock means is obstructed.

Thus, improvements are achieved according to the present invention in that a compensating arrangement is installed in the force transmission path between the eccentric element and the driven member, which driven member is usually slidably maintained within a guide frame. The compensating arrangement is effected in both sliding directions of the driven member and the motor means and/or the compensating arrangement is dimensioned in such a way that the motor means is capable of rotating the eccentric element even if the driven member or the lock means become obstructed.

As a result, the motor means can always rotate the eccentric element into a final position thereof even if the driven member is obstructed. In this final position, the motor means will be disconnected by the control circuit means.

In accordance with a more specific aspect of the invention, the driven member may be formed as a frame having two elastic compensating elements which are arranged opposite each other and spaced apart in the sliding direction of the driven member with the eccentric element engaging between these two compensating elements. The compensating elements may be formed as blocks of rubber or similar elastic material. However, in a preferred embodiment of the invention, compression springs which are supported at the driven member frame are provided. If necessary, sliding members may also be provided which are slidably guided at the frame in its sliding direction in order to reduce damage due to wear.

The driving mechanism is particularly suitable for use in the central locking system of a motor vehicle especially when each of the driving mechanisms is provided with a control switch by means of which the remaining driving mechanisms of the central locking system in the unlocking position of one of the driving mechanisms can also be controlled into the unlocking position. In this manner, if one of the locking devices of the motor vehicle locks is obstructed, it will be prevented that this lock will remain unlocked without being noticed when the central locking system is locked while the remaining locks are correctly locked. The control switch of the driving mechanism of that lock which remains unlocked in this case steers all remaining locks into the unlocked position which usually will not remain unnoticed by the operator of the vehicle.

As a result, an indication of a malfunction in the locking system will be provided if any one of the locking elements remains unlocked.

The compensating arrangement permits manual adjustment of the drive member of the eccentric drive mechanism independently from the position of the eccentric element and consequently the motor vehicle lock may also be unlocked or locked manually. The driving mechanism may be expanded in a simple manner to include a theft protection function will prevent manual unlocking of the lock. For this purpose, a second drive member may be coupled with the eccentric element which can be moved by the eccentric element transversely to its rotational axis along a guide device which is attached to the motor with this driven member mechanically blocking in a first position the unlocking mechanism which is to be manually actuated against manual activation and releases it in a second position. Advantageously, the final positions of the eccentric element are always rotated further by 90° against the angular positions which move the driven element into the first or the second position. In this way, the eccentric element can be held by means of a limit switch, when the theft protection is turned on, in an intermediate position in which driven members take up a dead center position of the sliding movement.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
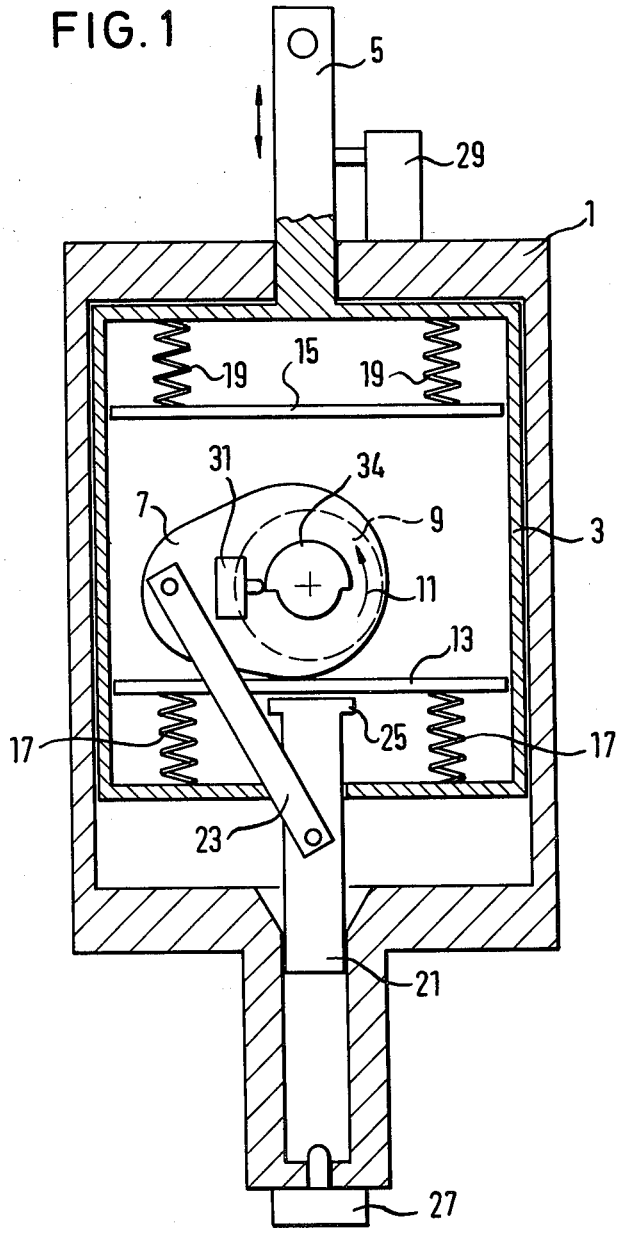
FIG. 1 is a schematic sectional view showing a driving mechanism for the lock system of a motor vehicle door or other like elements of the vehicle, structured in accordance with the present invention.

Referring now to the drawings, the locking system of the present invention is provided with a driving mechanism in accordance with FIG. 1 which is formed with an essentially closed housing 1 having therein a frame 3 supported and guided for sliding movement. The frame 3 is rigidly connected with a rod 5 which projects beyond the housing 1. The rod 5 is connected to a locking element (not shown) of one of several locks of a motor vehicle which is to be controlled by operation of the invention, as will be more fully explained hereinafter. The locking system of the locking element may be manually locked or unlocked by means of a key or by manual actuation of a button such as that which may be provided on the door of a vehicle. A locking element of the locking system is unlocked when the rod 5 and the frame 3 are in the position shown in FIG. 1. When the rod 5 and the frame 3 are moved into a final position toward the bottom as viewed in FIG. 1, the locking element is brought to the locked position.

An eccentric cam 7 arranged within the housing 1 is mounted to be unidirectionally rotated in a direction indicated by the arrow 11. An electrical geared motor 9 which is flanged to the housing 1 is provided for driving the eccentric cam 7.

The eccentric cam 7 operates to engage a pair of sliding or movable plates 13 and 15 which are supported on the frame 3 in order to drive the frame 3 and the rod 5 between the unlocking position and the locking position of a respective locking element. The sliding plates 13, 15 are arranged on both sides of the eccentric cam 7 taken in the sliding direction of the frame 3 and they are themselves mounted so as to be movable relative to the frame 3 in the sliding direction of the frame 3.

The plates 13 and 15 are made slidably movable relative to the frame 3 by means of compression springs 17 and 19, respectively, interposed between the plates 13, 15 and the frame 3. The lengths of the paths of movement of the sliding plates 13, 15 are dimensioned in such a manner that the eccentric cam 7 can rotate against the pressure of the compression springs 17 and 19 past the sliding plates 13 or 15 even when the frame 3 is in the final position which has been reached always when the other sliding plate is acted upon. In addition, the force of the compression springs 17 and 19 as well as the driving power of the geared motor 9 are dimensioned in such a way that the eccentric cam 7 during normal operation can move the frame and the locking system connected therewith, while if the frame 3 or the locking system of the lock is obstructed, the eccentric cam 7 can rotate over the hindering sliding plate. In its stoppage position, the eccentric cam 7 is always rotated further by 90° against the angular position which it occupies when reaching the final position of the frame 3.

A blocking element 21 is also movably supported in the sliding direction of the frame 3 at the housing 1, the element 21 being coupled by means of a guide rod 23 with the eccentric cam 7. The eccentric cam 7 moves the blocking element 21 in the same direction with the frame 3 wherein, however, the lift of the blocking element 21 is greater than the lift of the frame 3. The blocking element 21 and the frame 3 reach the dead center positions which are located at the top or the bottom in FIG. 1 at the same angular position of the eccentric cam 7. On the blocking element 21, a projection 25 is installed which engages behind the frame 3 on the side which is located in the unlocking direction of the frame 3. This projection locks the frame 3 against manual shifting in the bottom dead center position which corresponds to the locking position of the lock.

The geared motor can be stopped in the locking dead center position if a theft protection circuit (not shown) of the motor vehicle is activated.

The driving mechanism is controlled by means of two switches 29 and 31, with the switch 29 being operated in dependence on the position of the rod 5 or a part fixedly connected with this rod, and with the switch 31 being operated in dependence on the position of the eccentric cam 7 or a part which is firmly connected therewith.

Figure 2:
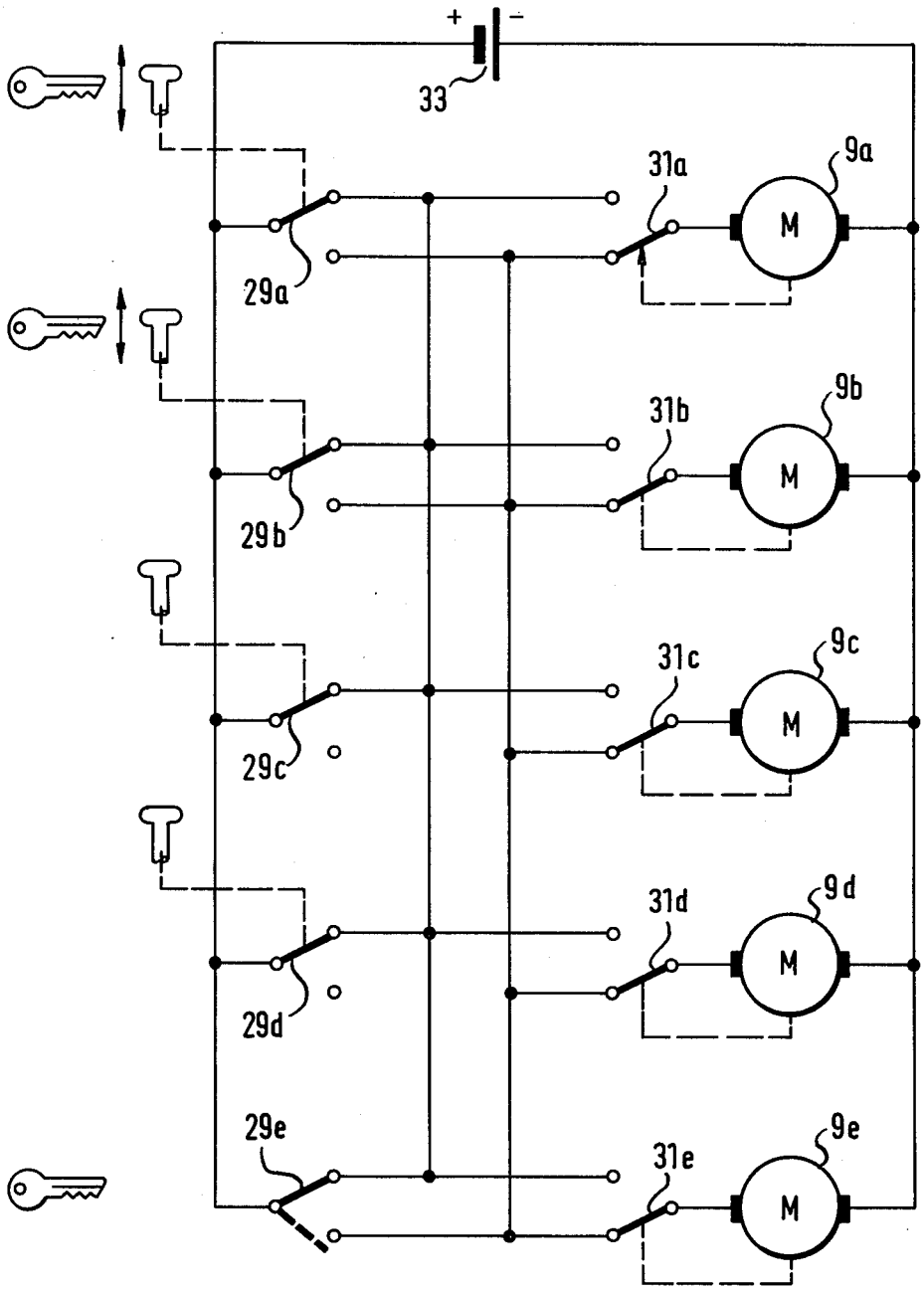
FIG. 2 is a circuit diagram for a central locking system for the motor vehicle which is structured utilizing the driving mechanism depicted in FIG. 1.

FIG. 2 shows details of a control circuit of a central locking system of a motor vehicle which is constructed with the driving mechanism according to FIG. 1. The switches 29 and 31 and the geared motors 9 which belong to the same driving mechanism are identified with similar reference characters. The driving mechanisms identified with the reference characters a and b drive the locking elements in the front doors of the vehicle which can be locked or unlocked manually by means of a key as well as also by means of actuating buttons in the doors. The driving mechanisms identified by reference characters utilizing reference letters c and d may be connected to close the rear doors of the vehicle which may also be manually locked by means of actuating buttons. The driving mechanism identified with e locks the trunk of the vehicle.

The motors 9 are connected in parallel always with one connection, at the one pole of a vehicle battery 33 whose other connection is connected in parallel with all center contacts of the switches 29. The other connection of the motors 9 is connected with the movable contact of the respectively assigned switches 31. The switches 31 are constructed as reversing switches wherein always the respective contacts are connected parallel with each other. The switches 31 are operated, for example, by means of a cam 34 in such a manner that they are switched over when the respective final position of the eccentric cam 7 has been reached. The switches 29*a* and 29*b* are also constructed as reversing switches. Their fixed contacts are connected with the fixed contacts of the assigned switches 31*a* and 31*b* in such a way that during switching over of the switches 29*a* or 29*b* the electrical circuit of the motors which are joined in parallel by means of the switch 31*a* or 31*b* which is waiting in the always other final position. In FIG. 2, the switches 29*a* and 29*b* are shown in the unlocking position. The unlocking position of the eccentric cam 7 corresponds to the position of the switches 31*a*–31*e* which is shown. When the switch 29*a* or 29*b* is switched over, all the motors 9*a*–9*e* are connected until the other final position is reached in which the switches 31*a*–31*e* change over into the position shown at the top in FIG. 2. In this position the locks are locked.

The switches 29*c* and *d* are shown as on-off switches which are closed in the unlocking position. They ensure that if the assigned driving mechanism is blocked, all driving mechanisms of the central locking system are again unlocked, even if they were already locked and this will give an indication of a malfunction.

In addition to the switches 29*a*–29*e*, a switch may be provided which is connected in parallel and which is actuated depending on acceleration and which unlocks during an accident any door which may be locked.

The switch 29*c* is constructed as a reversing switch actuated by means of a key—like switches 29*a* and 29*b* resp.,—except that this switch includes an electrically functionless switch position (indicated by dotted switch position). This functionless switch position is necessary to allow obstruction of the electromotively operated gear, if only the trunck remains locked and the doors are to be unlocked, when the car is in the repair shop, for example.

The switches 27, 29*a*–29*e* and 31*a*–31*e* may also be constructed as inexpensive sliding contacts.

While a specific embodiment of the invention has been shown and described in detail to illustrate the application of the inventive principles, it will be understood that the invention may be embodied otherwise without departing from such principles.

What is claimed is:

1. A locking system particularly suitable for motor vehicles for use with unidirectional electrical motor means comprising: lock means movable between a locking position and an unlocking position; a driven member coupled with said lock means; eccentric drive means for engaging said driven member to move said lock means between said locking position and said unlocking position; motor means for rotatively driving said eccentric drive means; control circuit means including switch means responsive to the position of said lock means for controlling operation of said motor means; and elastic means interposed between said driven member and said eccentric drive means to permit said motor means to continue to rotatively drive said eccentric drive means when movement of said lock means is obstructed; wherein said driven member is formed as a frame member and wherein said elastic means comprise a pair of elastic compensating elements arranged spaced apart opposite each other in the direction of movement of said driven member, said eccentric drive means being arranged to engage between said two compensating elements; said compensating elements including sliding parts for said eccentric drive means which are supported by means of compression springs at said frame member and which are slidably guided at said frame in the sliding direction of said frame.

2. A system according to claim 1 wherein said driven member, said eccentric drive means, and said elastic means are arranged in an essentially closed housing from which said driven member projects so as to be slidable relative thereto.

3. A system according to claim 1 wherein said switch means include control switches mechanically coupled with said driven member to be switched in accordance with the position thereof and limit switches mechanically coupled with said eccentric drive means to be switched in accordance with the position thereof.

4. A system according to claim 1 wherein said limit switches operate to terminate actuation of said motor means at a final position at which said eccentric drive means is further rotated by approximately 90° against the angular position, moving said driven member into a first or a second position thereof.

5. A system according to claim 1 wherein said lock means comprise a plurality of locking elements, wherein said motor means comprise a plurality of individual motors each adapted to drive one of said locking elements and wherein said switch means include individual control switches individually associated with said individual motors, said motors being connected in parallel to effect formation of a central locking system for a motor vehicle in such a manner that said motors can be individually connected by means of said control switches to operate one of said locking elements.

6. A system according to claim 5 wherein there is provided a driven member coupled with each of said locking elements and wherein a control switch is mechanically coupled with each of said driven members to connect one of said motors at least for movement of said locking elements of said lock means between one of said locking and said unlocking positions 7. A locking system particularly suitable for motor vehicles for use with unidirectional electrical motor means comprising: lock means movable between a locking position and an unlocking position; a driven member coupled with said lock means; eccentric drive means for engaging said driven member to move said lock means between said locking position and said unlocking position; motor means for rotatively driving said eccentric drive means; control circuit means including switch means responsive to the position of said lock means for controlling operation of said motor means; and elastic means interposed between said driven member and said eccentric drive means to permit said motor means to continue to rotatively drive said eccentric drive means when movement of said lock means is obstructed; said eccentric drive means comprising an eccentric element rotatively driven by said motor means and a second driven member coupled to be driven by said eccentric element transversely to the rotational axis of said eccentric element along a guide, said second driven member being adapted to mechanically block in a first position a manually actuable locking system of said lock means against manual actuation and, in a second position, being adaptable to release this locking system.

8. A system according to claim 7 wherein said second driven member is in its first position when said eccentric element is between two final positions thereof and wherein a limit switch is coupled with said eccentric drive means to be switched thereby to effect stopping of said motor means at an intermediate position.

9. A system according to claim 7 wherein said eccentric element operates to move said second driven member between two dead center position, said second driven member being pressed against said driven member in one of said dead center positions.

10. A system according to claim 7 wherein said second driven member is coupled with said eccentric element by means of a guide rod.

11. A locking system particularly suitable for a motor vehicle for use with unidirectional electrical motor means comprising: lock means including a plurality of locking elements each individually movable between a locking position and an unlocking position; a driven member coupled with each of said locking elements; a plurality of eccentric drive elements each engaging one of said driven members to move said locking elements individually between said locking and unlocking positions; a plurality of motors connected to rotatively individually drive said eccentric drive elements; and control circuit means including switch means responsive to the position of said locking elements for controlling operation of said motors to move all of said locking elements to the locking positions thereof when one of said locking elements is moved to the locking position; said switch means including a plurality of switches each individually responsive to the position of one of said locking elements; said control circuit means operating to actuate all of said motors to return all of said locking elements to their unlocking positions if any one of said locking elements fails to move to the locking position thereof after said motors have been energized by said control circuit means to move all of said locking elements to their locking positions.

12. In a locking system particularly suitable for a motor vehicle for use with unidirectional electrical motor means including a plurality of locking elements movable between a locking position and an unlocking position, a plurality of motors each connected to individually actuate said locking elements, and control circuit means including switch means responsive to the position of said locking elements for controlling operation of said motor means, the improvement comprising a driving mechanism interposed between each of said motors and said locking elements, said driving mechanism comprising a driven member coupled with each of said locking elements, an eccentric drive element engaging said driven member to move said locking elements between said locking and said unlocking position, and elastic means interposed between said driven member and said eccentric drive element to permit said motors to continue to rotate said eccentric drive element when movement of any one of said locking elements is obstructed, wherein said control circuit means connects said motors in parallel with each other, and wherein said switch means comprise a plurality of control switches mechanically coupled with said individual driven members of said locking elements to be switched in accordance with the position of said driven members, said switch means further comprising a plurality of limit switches mechanically coupled with individual ones of said eccentric drive elements of each of said driving mechanisms, said limit switches being switched in accordance with the position of said eccentric drive elements; each of said limit switches being arranged to energize all of said motors to move said locking elements to said unlocking positions thereof if any one of said locking elements remains in the unlocking position when said motors are energized by said control circuit means to move all of said locking elements to the locking position.

* * * * *